United States Patent [19]

Barbieri

[11] Patent Number: 4,650,011

[45] Date of Patent: Mar. 17, 1987

[54] METHOD AND APPARATUS FOR DRILLING A HOLE IN AN ICE FORMATIONS AND PUMPING WATER OUT FROM SUCH HOLE

[76] Inventor: Louis C. Barbieri, 9407 E. Marginal Way South, Seattle, Wash. 98108

[21] Appl. No.: 541,152

[22] Filed: Oct. 12, 1983

[51] Int. Cl.[4] ..... F25C 5/04

[52] U.S. Cl. ..... 175/18; 175/203; 299/25; 173/28; 173/43

[58] Field of Search ..... 175/18, 203; 299/25, 299/26; 248/661, 669; 173/28, 43, 147, 152

[56] References Cited

U.S. PATENT DOCUMENTS

| | | | |
|---|---|---|---|
| 698,013 | 4/1902 | Halsall et al. . | |
| 964,464 | 7/1910 | Crawford-Frost . | |
| 2,676,471 | 4/1954 | Pierce, Jr. | 62/172 |
| 2,727,366 | 12/1955 | Hagen | 62/139 |
| 2,763,939 | 9/1956 | Zamboni | 37/13 |
| 2,968,164 | 1/1961 | Hanson | 62/74 |
| 3,146,951 | 9/1964 | Brown | 239/399 |
| 3,288,229 | 11/1966 | Chappuis | 173/147 |
| 3,301,485 | 1/1967 | Tropeano et al. | 239/2 |
| 3,340,938 | 9/1967 | Wilson | 173/147 |
| 3,447,613 | 6/1969 | Lisenby | 173/28 |
| 3,474,872 | 10/1969 | Danuser | 173/147 |
| 3,475,056 | 10/1969 | Jones | 299/24 |
| 3,515,228 | 6/1970 | Henson | 173/28 |
| 3,570,607 | 3/1971 | Wennervirta et al. | 173/28 |
| 3,705,746 | 12/1972 | McLeod | 299/25 |
| 3,732,935 | 5/1973 | Gibson | 173/147 |
| 3,844,126 | 10/1974 | Blurton et al. | 61/46.5 |
| 4,094,149 | 6/1978 | Thompson et al. | 61/1 R |
| 4,187,039 | 2/1980 | Jahns et al. | 405/217 |
| 4,192,630 | 3/1980 | Duthweiler | 405/217 |
| 4,242,012 | 12/1980 | Utt | 405/217 |
| 4,278,140 | 7/1981 | Oswald et al. | 173/28 |
| 4,442,904 | 4/1984 | Wibom | 173/28 |

*Primary Examiner*—Stephen J. Novosad
*Assistant Examiner*—William P. Neuder
*Attorney, Agent, or Firm*—Delbert J. Barnard

[57] ABSTRACT

An auger (16) and a pump unit (18) are mounted on opposite sides of a tower (42). Each is moved up and down the tower by a separate chain and sprocket drive (134, 146, 158, and 136, 148, 160). The assembly (16, 18, 42) is laterally shiftable in position, so that the auger (16) can be used to drill a hole in an ice formation (14). Then, the auger (16) can be withdrawn from the hole (372), and the assembly (16, 18, 42) can be shifted sideways, and then the pump (18) can be lowered into the hole (372). The pump (18) is a helical screw pump (176, 184) combined with a vortex pump (338, 202). A helical screw pump element (184) lifts water up into the vortex pump housing essentially directly to the vortex pump impeller (338). Such impeller (338) discharges the water laterally outwardly through a nozzle (202).

59 Claims, 14 Drawing Figures

Fig. 4
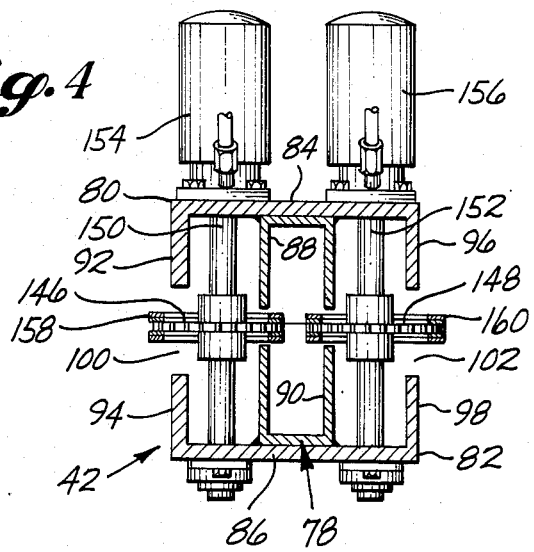
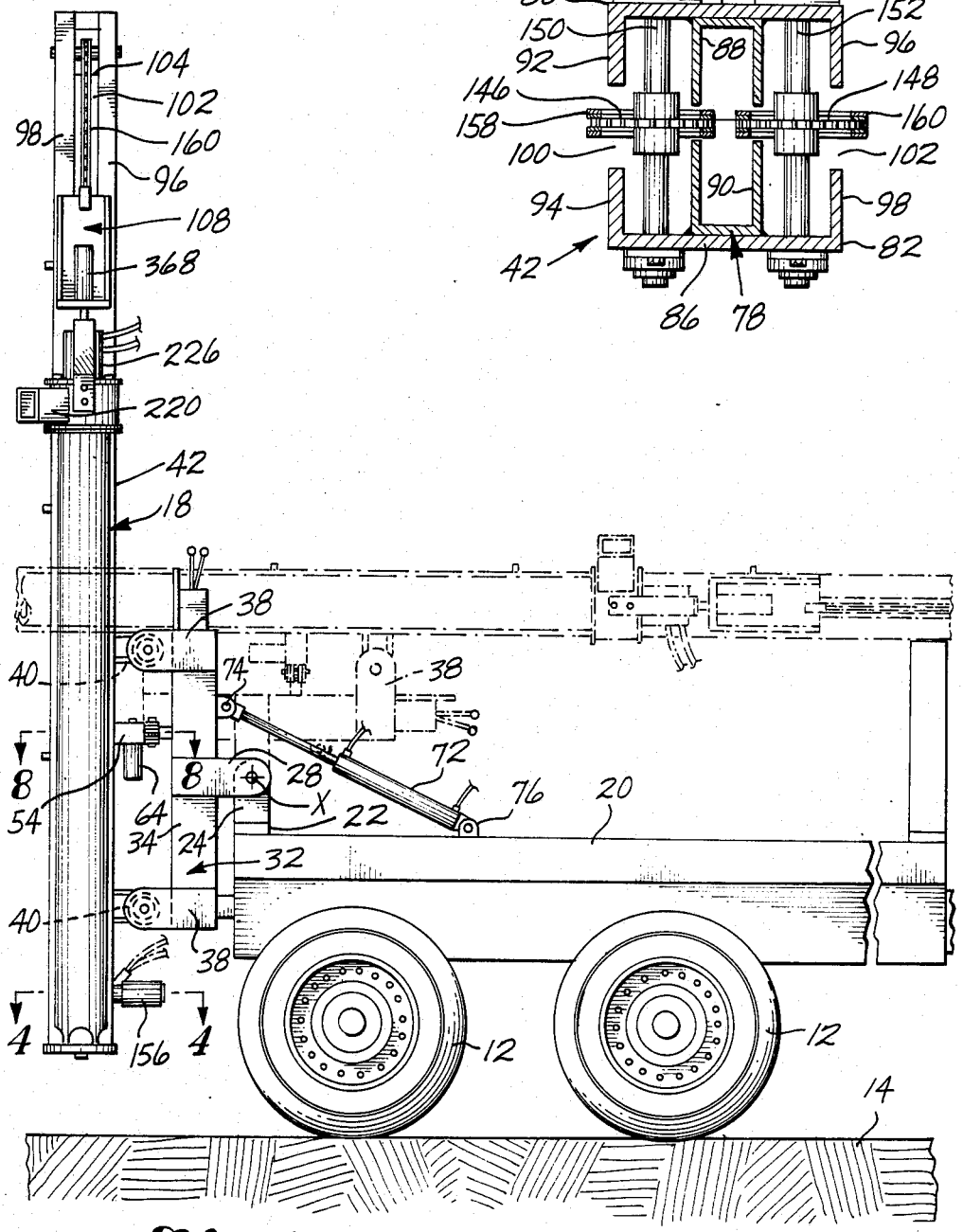
Fig. 5

Fig. 6
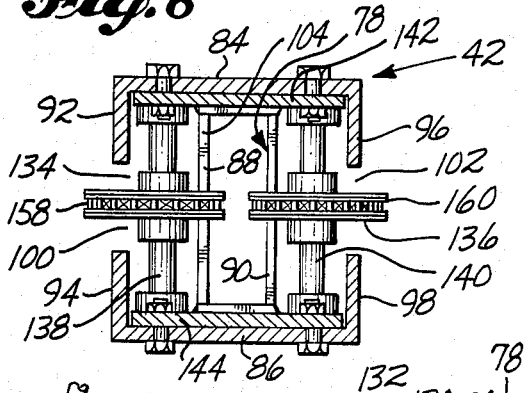
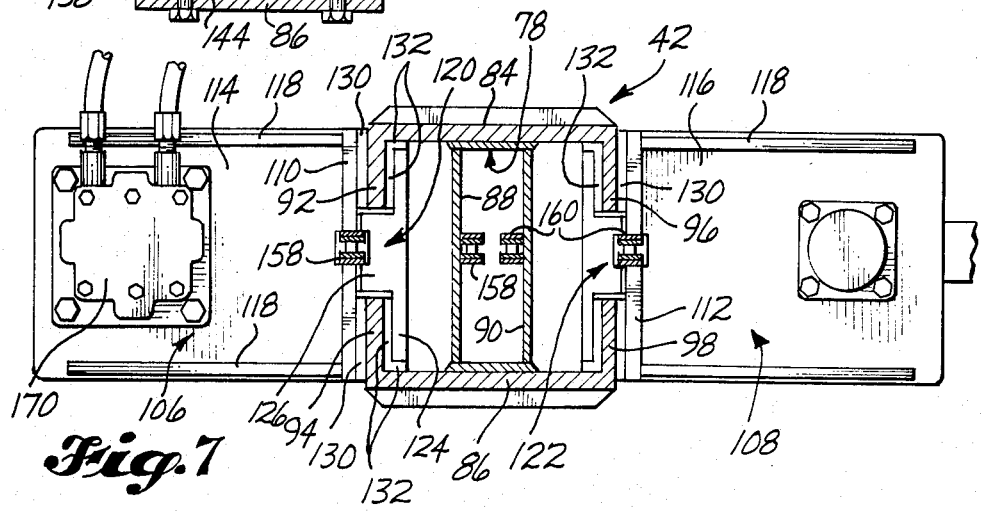
Fig. 7
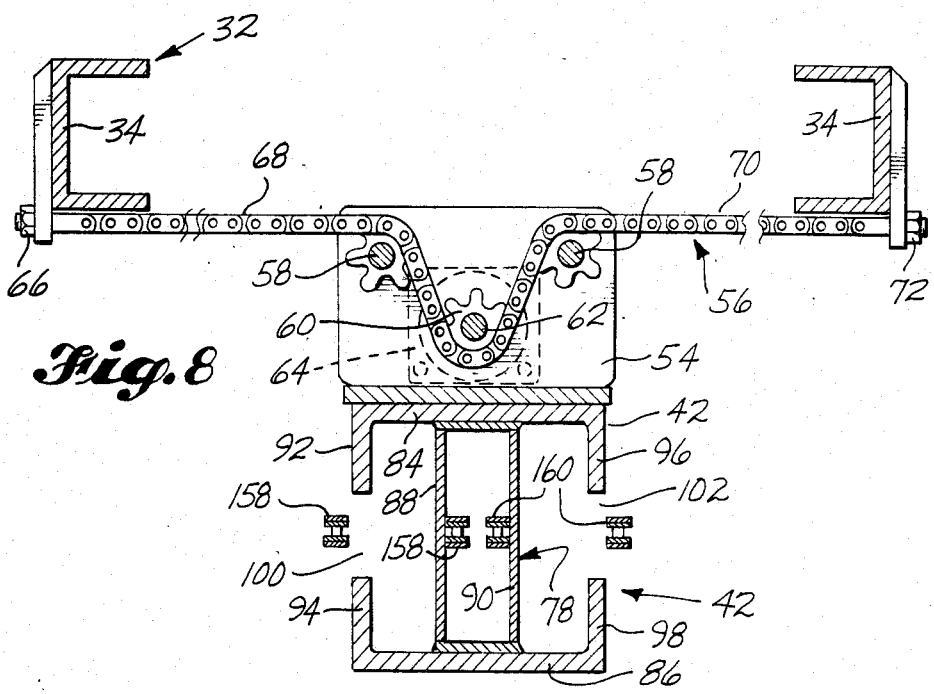
Fig. 8

METHOD AND APPARATUS FOR DRILLING A HOLE IN AN ICE FORMATIONS AND PUMPING WATER OUT FROM SUCH HOLE

DESCRIPTION

1. Technical Field

This invention relates to apparatus for boring holes in ice, and apparatus for pumping water out through such holes, and to a method of using such water to thicken an ice formation. It further relates to various component constructions and arrangements.

2. Background Art

It is known to thicken portions of ice formations in artic regions, to make such ice formations stronger. For example, ice roads have been constructed by pumping water onto ice formations for the purpose of building up or strengthening the ice formations where the road is desired. In the past, it has been the practice to drill a hole in the ice by use of a portable drill. Then, an inlet tube for a portable centrifugal pump is lowered into the hole and the pump is operated to pump water from below the ice onto the surface of the ice whereat it is desired to thicken the ice formation. The usual practice was to carry in the portable pump and then set it into the hole.

U.S. Pat. No. 4,192,630, granted Mar. 11, 1980, to Frederick C. Duthweiler address the problem of thickening an ice mass. However, the system used is limited to use in constructing ice islands and is not suitable for use in building ice roads.

There is a need for a vehicular mounted mechanism for first drilling a hole and then quickly inserting a pump into the hole and supporting the pump during its use for delivering water to form ice where thickening of an ice formation is desired. There is also a need for such a vehicle which is adapted to float in the event the ice formation breaks under its weight. And, there is a need for an improved pump capable of lifting and discharging large quantities of water in a relatively short amount of time.

The principal object of the present invention is to provide an auger/pump assembly, a floatable support vehicle for the assembly, and a high capacity pump unit.

DISCLOSURE OF THE INVENTION

In accordance with an aspect of the invention, an auger and a pump unit are mounted together, on opposite sides of an elongated support tower. The auger is movable downwardly and rotatable to form a hole in an ice formation. Then, the auger is retractable out from the hole and the assembly is shiftable in position laterally, to align the pump unit with the hole. Then, the pump unit is movable downwardly into the hole and operable for lifting large quantities of water out from beneath the ice and discharging such water through a nozzle onto a portion of the ice formation which is to be thickened.

The invention relates to (1) a construction of a support tower for the auger and the pump unit, which is capable of also being used for supporting other types of equipment as well, (2) a mechanism for laterally shifting in position the auger/pump assembly, or a similar tandem pair of tools, which are to be used in succession, (3) mechanisms for supporting the auger and the pump, or similar tools, for up and down travel, including a unique support column, (4) a vehicular mounting for a tandem tool assembly, and (5) various component features of the equipment.

The invention further relates to a unique and improved combined pump. An inefficient helical screw pump is combined with an inefficient vortex pump to make an efficient new pump having a long tubular axial inlet and a generally radial outlet.

The detailed description of the illustrated embodiments and the claims also constitute portions of this disclosure of the invention.

BRIEF DESCRIPTION OF THE DRAWINGS

In the drawings, like reference numerals are used to identify like parts throughout the several views, and:

FIG. 4 is a cross sectional view taken substantially along line 4—4 of FIG. 5, and showing drive motors mounted onto a lower portion of the support column and connected to drive shafts which carry sprocket wheels, and further showing the construction of the support column;

FIG. 5 is a fragmentary side elevational view of a vehicle having an auger/pump assembly mounted onto a rear portion of its bed, said view including a solid line showing the assembly in its upright or in use position, and a broken line showing the assembly in its supine transport position;

FIG. 6 is a cross sectional view taken substantially along line 6—6 of FIG. 1, and showing the mounting of the sprocket wheels at the upper end of the support column;

FIG. 7 is a cross sectional view taken substantially along the line 7—7 of FIG. 2, showing the manner in which the support brackets for the upper ends of the auger and the pump unit are mounted and guided for up and down movement longitudinally of the support column;

FIG. 8 is a fragmentary sectional view taken substantially along line 8—8 of FIG. 5, showing a preferred form of driving the carriage sideways relative to its support frame;

BEST MODE FOR CARRYING OUT THE INVENTION

Figure 1:
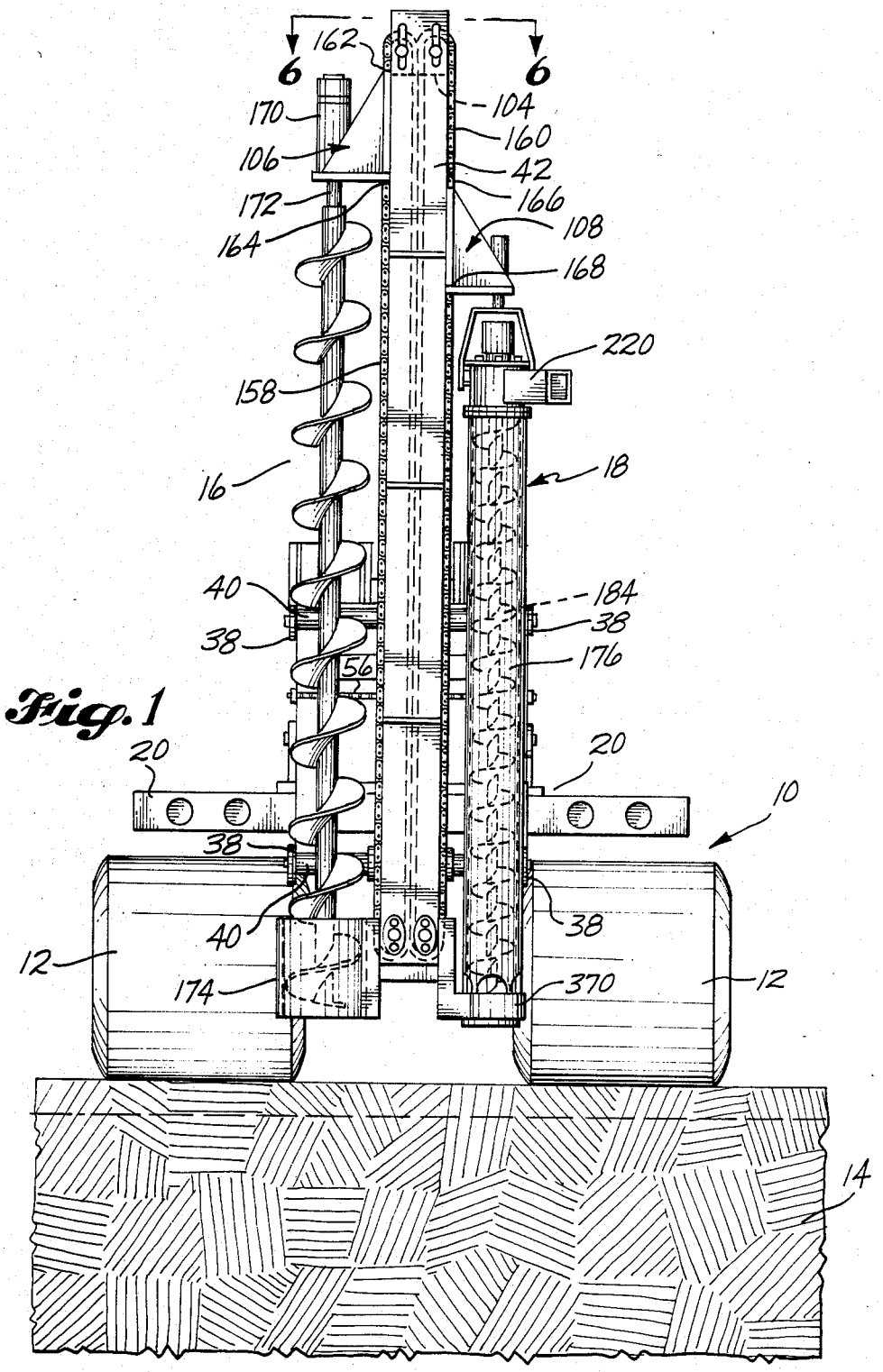
FIG. 1 is an end elevational view of an embodiment of the invention, showing the support tower in an upright position and the ice hole forming auger and the pump unit both in raised positions.

In preferred form, the transport vehicle 10 (partially depicted by FIGS. 1 and 5, and better depicted by FIG. 14) comprises large floatation wheels 12. The total weight of the vehicle 10 and the equipment carried thereby, and the number and size of the floatation wheels 12, are such that the vehicle 10 would float in the event the ice formation 14 breaks under the weight of the vehicle 10.

In accordance with an aspect of the invention, an auger 16 and a pump unit 18 are mounted together on a rear portion of the vehicle bed 20.

Figure 12:
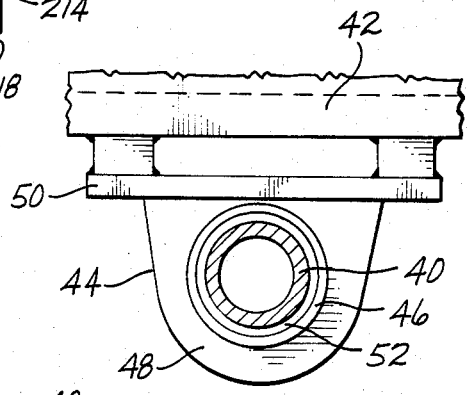
FIG. 12 is a fragmentary sectional view taken substantially along line 12—12 of FIG. 11.
Figure 11:
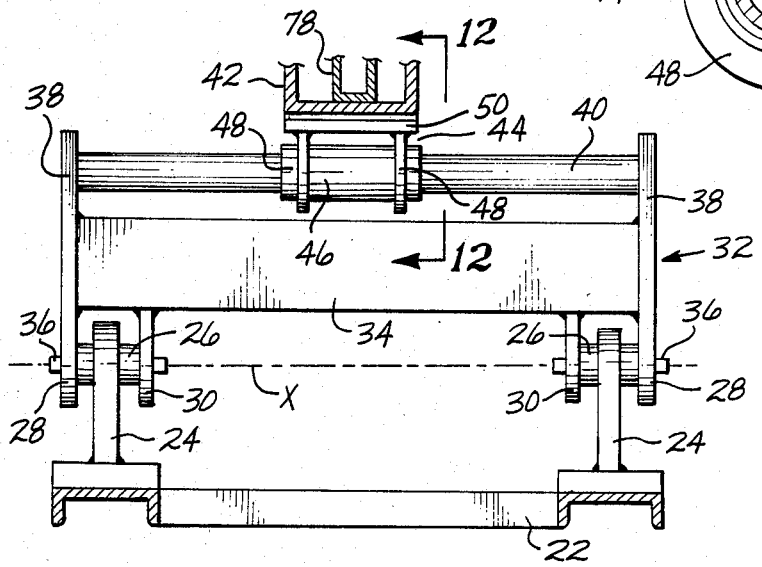
FIG. 11 is a fragmentary view of the support frame for the carriage, showing one of the carriage members and its relationship to the support column and a laterally extending guide member portion of the support frame, said view also showing the manner in which the support frame is mounted for tilting movement between its supline transport position and its generally vertical in use position.

As best shown by FIGS. 5, 11 and 12, in preferred form, a frame 22 is secured to the vehicle bed 20, generally at the rear end of the vehicle bed 20. Frame 22 mounts a pair of upwardly projecting ears 24. Each ear 24 carries a bearing tube 26 in which bearings are located. The mounting ears 24 and the bearing tubes 26 project upwardly into a space formed by and between ear portions 28, 30 of a support and guide frame 32. Ears 28, 30 are secured to a central frame member 34.

As shown by FIG. 5, frame 32 includes a pair of end frame members 34 which extend laterally in opposite directions from the ears 28. In another words, the ears 28, 30 extend perpendicular from the members 34, at a central location.

Mounting pins 36 extend through the ears 28, 30 and the bearings within bearing tube 26, to provide a pivotal mount for the frame 32, mounting frame 32 for pivotal movement about a horizontal axis X.

Ears 38 project from the end portions of frame members 34, in a direction opposite to the direction of projection of ears 28. As best shown in FIG. 11, the ears 38 provide end supports for elongated guide members 40, which may be formed from lengths of tubing. As shown by FIG. 5, there are two elongated guide members 40. They are spaced apart and are parallel to each other and to the axis X.

The mechanism includes an elongated support column or tower 42. Tower 42 carries a pair of identical carriage members 44, one of which is shown by FIGS. 11 and 12. The two carriage members 44 together constitute what is herein referred to as "the carriage".

Each carriage member 44 comprises a tubular body 46 and a pair of bracket plates 48. Plates 48 are secured both to the tubes 46 and to a plate 50 which is in turn secured to a portion of the tower 42. A bushing 52 is located inside of each tube 46, and mounts the carriage member 44 for sliding movement along the guide member 40. As will be evident, the two carriage members 44, and the two guide members 40, serve to accurately guide the tower 42 for sideways changes in position. The tower 42 includes a vertical axis Y (FIG. 2) which is perpendicular to the axes of tubes 40 and the horizontal axis X (FIG. 11).

As shown by FIGS. 5 and 8, a horizontal shelf plate 54 is secured to a forward portion of the tower 42, vertically between the two guide shafts 40 (FIG. 5). In preferred form, a length 56 of roller chain is interconnected between the side members 34 of frame 32. Support shelf 54 mounts two idler gears 58, for free rotation about vertical axes. The two gears 58 are spaced apart across the width of frame 52. A third gear 60, secured to the output shaft 62 of a drive motor 64, is positioned between the gears 58, but is offset from the gears 58 towards the tower 42. As shown by FIG. 8, the chain 56 extends from a first end connection 66, in a straight run 68 towards the opposite side of the frame. It meshes with and extends part way around the first idler gear 58, and then meshes with and extends around the driven gear 60. It then extends to the second idler gear 58, and extends part way around this second idler gear 58, and then resumes a straight run 70, over to a second end connection 72. As will be evident from an inspection of FIG. 8, operation of motor 64 to rotate gear 60 causes the gear 60 to travel relatively along the chain 56. The idler gears 58 also move relatively along chain 56, shortening one of the straight runs 68, 70 and lengthening the other, and moving the tower 42 sideways. As explained above, the sideways movement of the tower 42 is guided by the guide members 40 and the carriage members 44, so that the tower 42 always assumes a new position which is parallel to its last position.

Accordingly, the mechanisms 24, 26, 28, 30 mount the frame 32, and the tower 42 carried thereby, for pivotal movement about axis X. Specifically, this movement is between a substantially vertical in use position, shown by solid lines in FIG. 5, and a substantially supine transport position, shown by broken lines in FIG. 5. A double acting hydraulic cylinder 72 (FIG. 5) interconnected between a beam 35 (FIG. 3) and a mounting ear 76 on the vehicle bed 20. The cylinder 72 is lengthened to move the tower 42 up into its in use position, and is shortened for moving it down into its transport position. Cylinder 72 is also used for holding the tower 42 in a selected position.

As best shown by FIGS. 4–8, in preferred form, the support column 42 is of composite construction and comprises a box beam 78 sandwiched between two channel members 80, 82. The channel members 80, 82 open towards each other and the box beam is secured to central portions of the webs 84, 86 e.g. by welding. Box beam 78 is relatively narrow, so that spaces exist outwardly of its sides 88, 90, and inwardly of the flange pairs 92, 94 and 96, 98. The channel webs 84, 86 are in spaced parallelism. Webs 92, 94 are in coplanar parallelism and webs 96, 98 are in coplanar parallelism. The depth of beam 78 is larger than the combined depths of the flanges 92, 94 (or 96, 98), resulting in the creation of slots 100, 102, running the full length of the tower 42, on the sides thereof which include the flange pairs 92, 94 and 96, 98. The slots 100, 102 are defined by and between the free edges of the flange pairs 92, 94 and 96, 98.

Figure 2:
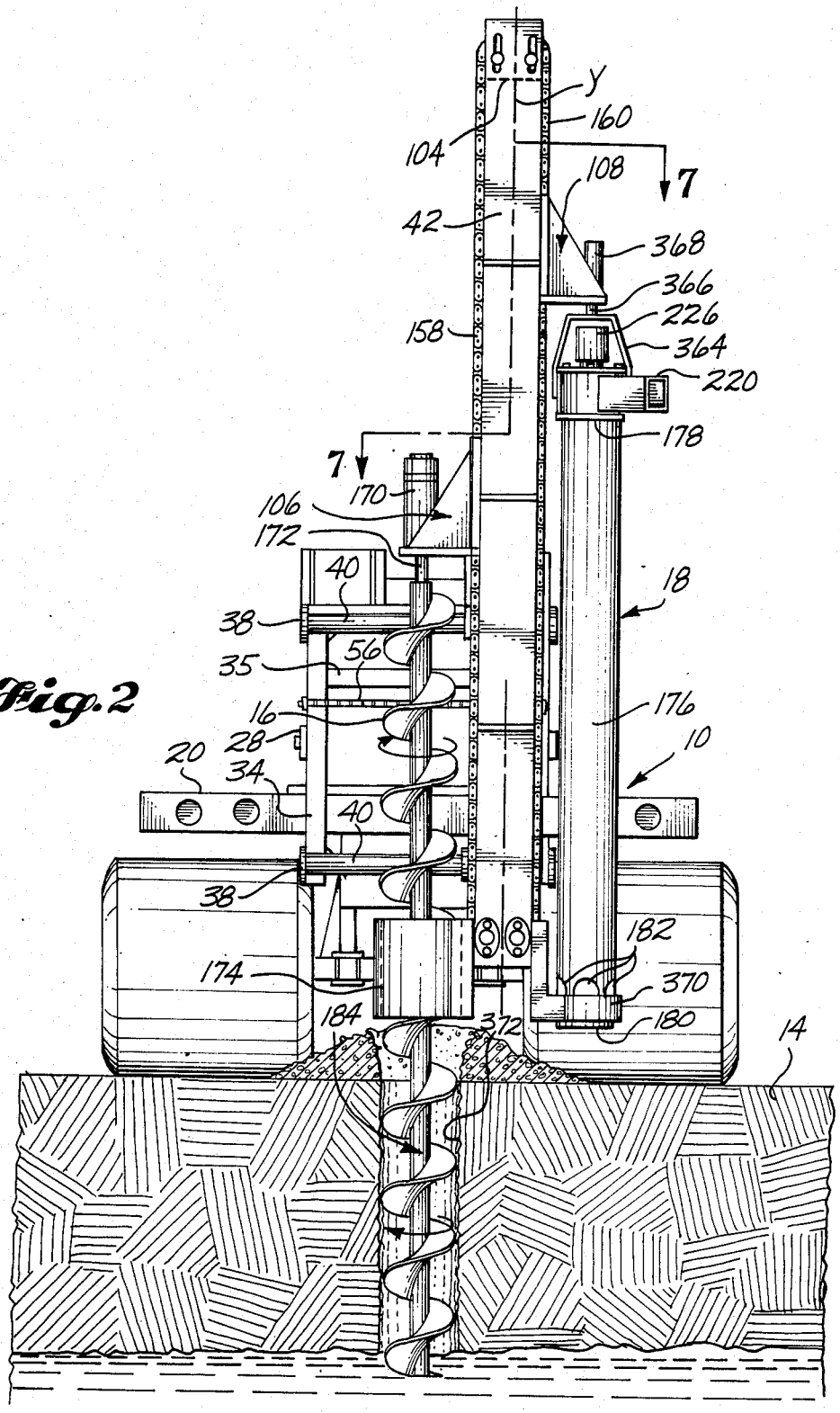
FIG. 2 is a view like FIG. 1, but showing the auger being lowered and rotated for the purpose of boring a hole through the ice formation.
Figure 3:
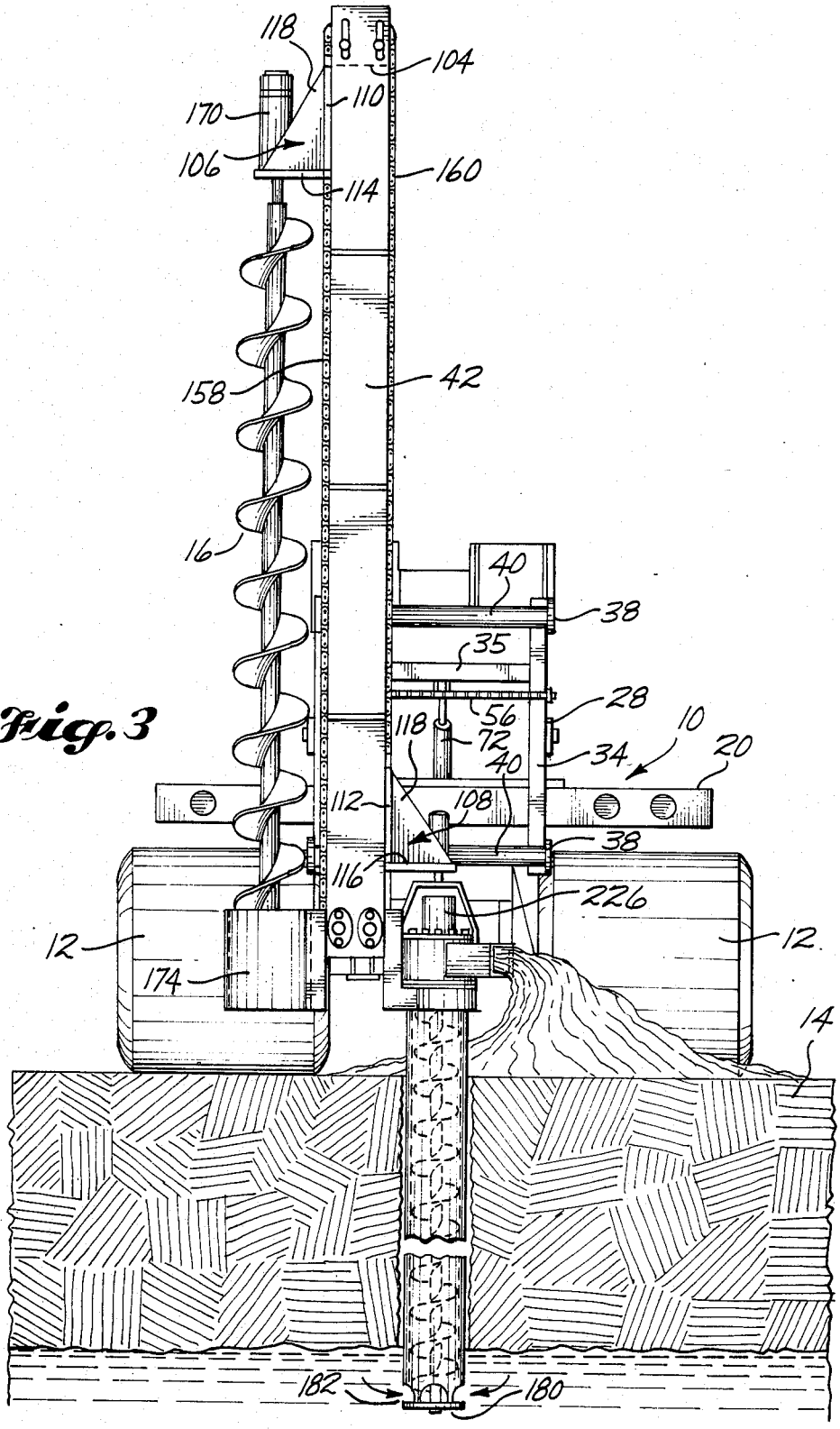
FIG. 3 is a view like FIGS. 1 and 2, but showing the auger raised, the carriage shifted in position to place the pump unit in alignment with the hole in the ice, and showing the pump lowered into the hole and being operated for the purpose of lifting water to the vortex pump and discharging the water out through the outlet nozzle onto the ice formation.

The box beam 78 does not extend the full length of the channels 80, 82. As shown by FIGS. 1–3, the top of the box beam 78 is at 104. In similar fashion, the bottom of box beam 78 is spaced upwardly from the lower ends of the channels 80, 82. This is done to provide space for sprocket gears within the tower 42, both above and below box beam 78.

In preferred form, the auger 16 and the pump 18 are suspended from support brackets 106, 108. Each bracket 106, 108 comprises a vertical base 110, 112, a horizontal support shelf 114, 116, and a pair of triangular gussets 118, extending between each shelf 114, 116 and the corresponding vertical base 110, 112.

Referring to FIG. 7, a first slide/guide member 120 is secured to bracket 106 and a second slide/guide member 122 is secured to support bracket 108. Member 120 includes a base portion 124 which is slightly narrower than the distance between the inside surfaces of the two webs 84, 86. Member 120 also includes a stem portion 126 which extends through the slot 100 and is secured to the vertical wall or base 110 of support bracket 106. Sheet bearing material 130 is disposed between wall 110 and flanges 92, 94, and is secured to the wall 110. In similar fashion, sheet bearing material 132 is located between base 124 of member 120 and the inner surfaces of the webs 92, 94. The bearing material 132 is secured to member 124 and it also extends into the regions between the side edgs of the base member 124 and the adjacent surfaces of the webs 84, 86.

The slide/guide member 120 and the bearing material 130, 132 mounts the support bracket 106 for accurate and easy sliding movement up and down the column 42. The square fit of member 124 with the space between webs 84, 86 prevents rotation of member 120.

The support bracket 108 is mounted for up and down movement in the same manner. Therefore, the details of construction will not be described except to identify the sheet bearing material 130, 132.

Referring to FIG. 6, at the upper end of column 42, generally above the upper end 104 of beam 78, a pair of sprocket wheels 134, 136 are mounted for rotation in a common plane which intersects the slots 100, 102. Sprocket wheel 134 is mounted on a shaft 138 and sprocket wheel 136 is mounted onto a shaft 140. Shafts 138, 140 are journaled for rotation at their ends by bearings which are mounted onto mounting plates 142, 144. The mounting plates 142, 144 are situated inside of the upper end portion of tower 42, and are bolted or otherwise secured to the webs 84, 86.

Referring to FIG. 4, a second pair of sprocket wheels 146, 148 are mounted for rotation within the lower end portion of tower 42. However, at this end, the journals are located outside of the webs 84, 86. Also, common ends of the support shafts 150, 152 are connected to the output shafts of hydraulic motors 154, 156. Thus, the sprocket wheels 146, 148 are power driven by the motors 154, 156. The sprocket wheels 134, 136 are passive.

Support bracket 106 is moved up and down column 42 by a drive chain 158. In similar fashion, support bracket 108 is moved up and down support column 42 by a drive chain 160. In preferred form, one end of drive chain 158 is secured to an upper portion of support bracket 106. Chain 158 extends from such point of connection up and over the sprocket wheel 134 and then extends downwardly through the interior of beam 78, to and around the sprocket wheel 146. It then extends upwardly to a second point of connection with the support bracket 106, at 164. In similar fashion, drive chain 160 is secured to support bracket 108 at 166. It then extends up and over sprocket 136, then down through the interior of box beam 78, to and around the sprocket 148, and then up to a second point of connection 168, with support bracket 108.

As shown by FIGS. 1–3, the upper pair of sprocket wheels 134, 136 are adjustably mounted so that the tenson in the drive chains 158, 160 can be adjusted by shifting the plates 142, 144 vertically.

As earlier stated, the auger 16 and the pump 18 are supported at their upper ends. Support shelf 114 (FIG. 7) mounts a hydraulic drive motor 170. The output of motor 170 is connected to auger drive shaft 172. The auger 16 is guided during use by means of a guide bushing 174 which is secured to a lower portion of tower 42. Guide bushing 174 includes a vertical passageway through which the auger 16 extends. When auger 16 is raised into its uppermost position (FIGS. 1 and 3) its lower end is located within the guide bushing 174. During use, drive motor 154 is operated to move drive chain 158, in a direction causing downward movement of the support bracket 106 and the auger 16 connected thereto. At the same time, motor 170 is rotated for the purpose of rotating the auger 16. Downward pressure is maintained by the drive chain 158, and the auger is guided during its use by the guide bushing 174 (FIG. 2).

The pump 18 comprises two pumping sections connected together in series. The first pumping section is a helical screw pump. The second is a vortex pump. The helical screw pump includes an elongated tubular housing 176, having a flange 178 at its upper end. The lower end 180 of housing 176 is open. Also, sidewall openings 182 (e.g. four) are formed in the housing 176 a short distance above the lower end 180. The open end 180 and the openings 182 together constitute the inlet for the helical screw pump. A helical screw pump element 184 is supported for rotation within the housing 176. Pump element 184 comprises a center shaft 186 and a helical blade 188 which extends about the shaft 184. Shaft 184 includes an end portion 190 which projects upwardly above the upper end 192 of blade 188.

Figure 9:
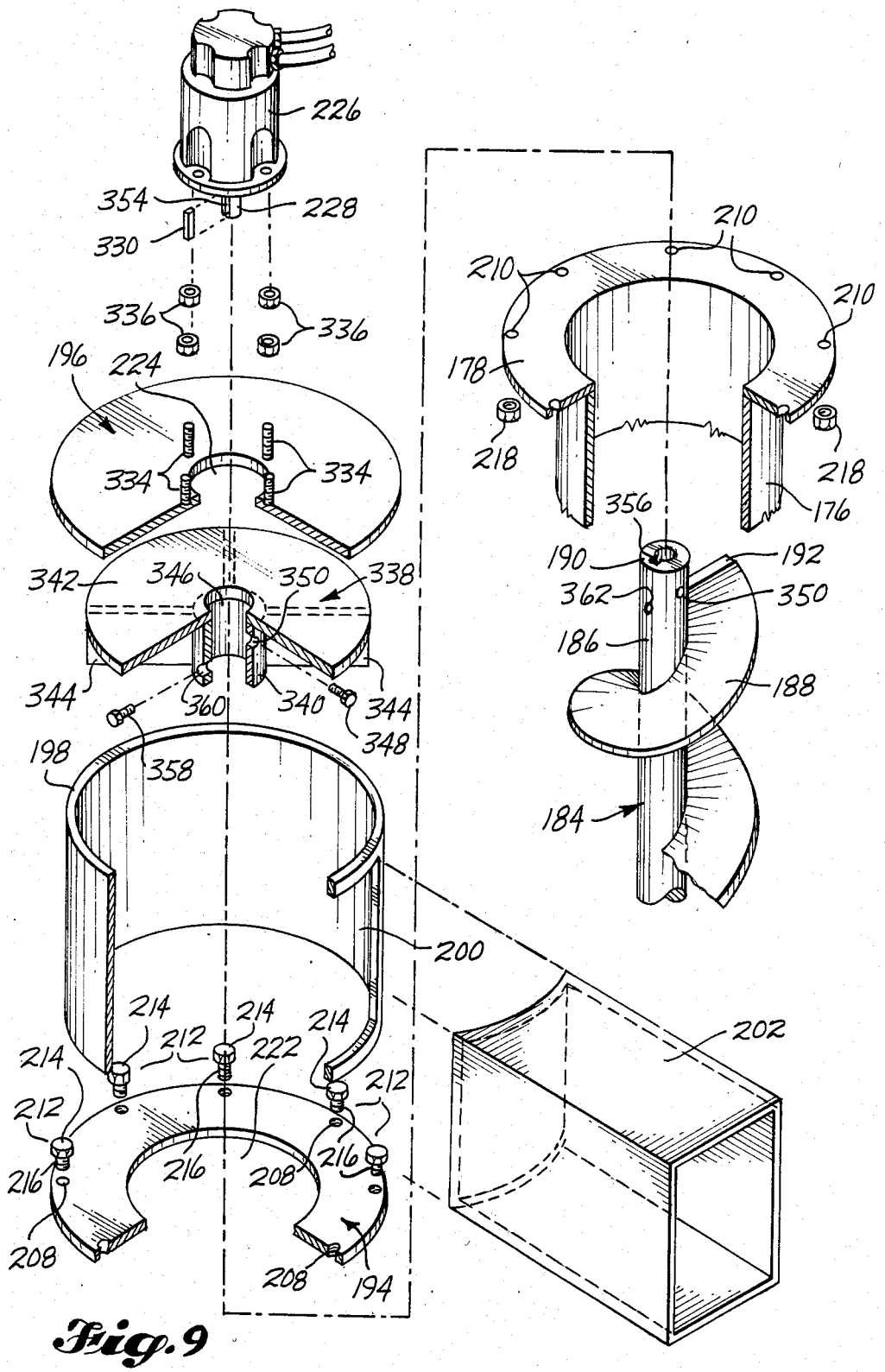
FIG. 9 is a fragmentary exploded view of the upper end portion of the pump unit, showing a preferred manner of securing the inlet tube to the vortex pump housing and connecting the helical screw pump element and the vortex pump impeller together.
Figure 10:
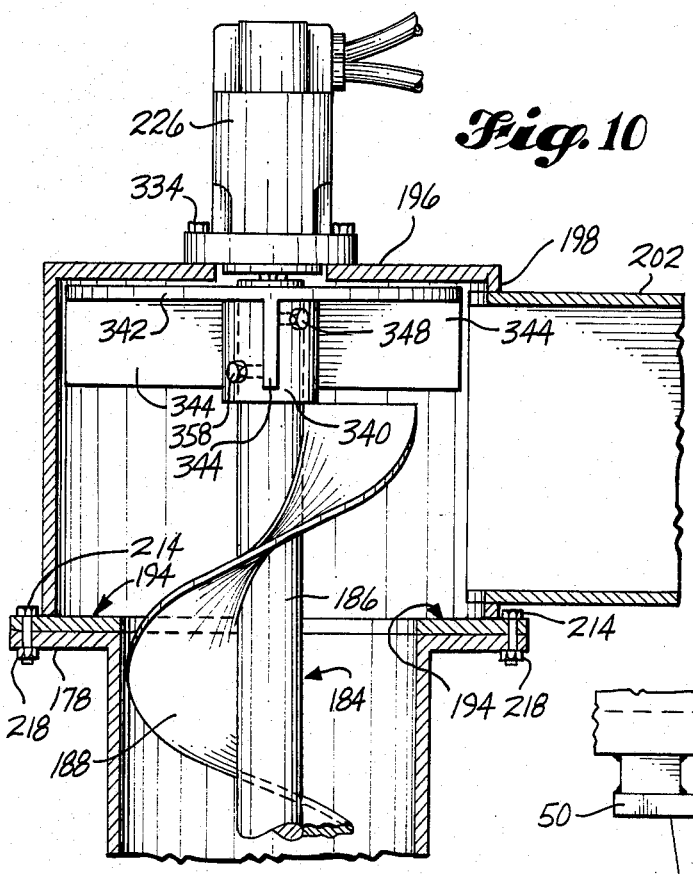
FIG. 10 is a longitudinal sectional view of the upper end portion of the pump unit, with the drive motor, the vortex pump impeller and the helical screw pump element shown in side elevation.

As best shown by FIGS. 9 and 10, the vortex pump housing includes an annular lower end wall 194, an annular upper end wall 196, and a cylindrical sidewall 198. Wall 198 includes an outlet port 200. A discharge nozzle 202 is secured to wall 198 about port 200. Nozzle 202 may be rectangular in construction, as pictured. Nozzle 202 projects radially outwardly from the sidewall 198. The exact direction may be exactly on a radial line, or at tangent to sidewall 198, or somewhere in between.

In preferred form, the end walls 194, 196 are welded to the lower and upper edge portions of cylindrical wall 198. Wall 194 is formed to include a circular array of bolt openings 208. The opening 208 is aligned with opening 210 formed in the flange 178. Tie bolts 212 extend through the aligned openings 208, 210. The upper end of each bolt 212 may include a head 214 and the upper end may be threaded at 216 to receive nuts 218 which secure the bolts 212 in place, in a very well known manner.

End wall 194 includes a center opening 222 which forms an axial inlet for the vortex pump. End wall 196 includes a central opening 224 through which the lower end portion of a hydraulic drive motor 226 extends. Motor 226 includes an output shaft 228 which is connected by a key 330 to the upper end 190 of shaft 186. As shown by FIG. 10, the drive motor 226 is connected to wall 196 by means of nut and bolt assemblies 334, 336.

The vortex pump includes an impeller 338 which includes a tubular hub 340. Impeller 338 also includes a top plate 342 and a plurality of radial blades 344 (e.g. four). A second cross pin 358 extends through first an opening 360 in hub 340 and then into an opening 362 in shaft end portion 190. Pins 348, 358 serve to firmly connect together the helical screw pump element 184 and the impeller 338, so that they will rotate together. A first cross pin 348 extends through first a sidewall opening 350 in hub 340 and then into an opening 350 in shaft portion 190. The upper end portion 190 of shaft 184 projects into the lower portion of impeller hub 340. The key 330 fits into both a key slot 354 in output shaft 228 and a key slot 356 in shaft end portion 190, and rotatably couples together the output shaft 228 and the screw shaft 186.

As best shown in FIG. 10, the upper end portion of the helical screw pump element 184 projects into the vortex pump housing.

In preferred form, the upper end 192 of helical blade 188 terminates contiguous a lower edge of one of the impeller blades 344. The diameter of impeller 338 is larger than the diameter of the screw element 184 and only slightly smaller than the diameter of the vortex housing.

In preferred form, the axial depth of the interior of the vortex pump housing is about three times the depth of the impeller 338. The helical blade 188 extends upwardly into and is operational within about the lower two thirds of such housing.

The pump 18 is suspended from support bracket 108. The suspension mechanism may include a bail 364 having lower side portions which are secured in any suitable manner to the vortex pump housing. The top of bail 364 may be secured to a shaft 366 of a rotary motor 368, provided for directional control of nozzle 220. Of course, the pump 18 can be suspended in many different ways. For example, it may be suspended from the end of a cable depending downwardly from a crane boom.

Referring to FIGS. 1–3, a second guide bushing 370 is secured to a lower portion of tower 42. Guide bushing 370 includes an opening through which the pump inlet tube 176 extends. As shown by FIGS. 1 and 2, when pump 18 in its elevated position, the lower end portion of tube 176 is within the guide bushing 370.

A helical screw type pump is by itself a quite inefficient pump. Also, a vortex pump is by itself a quite inefficient pump. However, it was found that a combination of these two types of pumps resulted in a very efficient pump. The helical screw pump element elevates water up to the level of the impeller 338. Impeller 338 acts on a rotating body of water and functions to add sufficient energy to the water to expel it out through the nozzle 220 under considerable force. Thus, the water is first lifted and then smoothly discharged laterally and the flow rate is substantial.

In operation, the vehicle is driven onto an ice formation 14 and is stopped where it is desired to thicken the ice formation 14. Then, the hydraulic motor 170 is turned on to rotate the auger and the hydraulic motor 154 is operated to drive the support bracket 106, and the auger 16 carried thereby, in downward direction, at the desired drill rate. The auger 16 functions in the usual manner to drill an hole 372 in the ice formation 14 and raise the cutting up to the surface (FIG. 2).

After the hole 372 is formed, the auger is raised back up to its elevated position. Then, the hydraulic motor 64 is turned on and used for shifting the auger/pump assembly sideways, until the pump tube 176 is in alignment with the hole 372. Then, hydraulic motor 156 is operated to lower the support bracket 108 and the pump 18 which is suspended therefrom. The pump 18 is lowered until its lower end inlet 180 and the inlet openings 182 are in the water below the ice formation 14 (FIG. 3). Motor 226 is then operated to rotate both the impeller 338 and the helical screw pump element 184. Water is elevated in tube 176 by the helical screw pump element 184, up to the vicinity of the impeller 338. Impeller 338 then functions to force the water laterally outwardly through discharge nozzle 208. The nozzle 220 is directed in the direction where it is desired to thicken the ice formation 14. The water which leaves nozzle 220 falls onto the ice formation 14 and substantially immediately freezes, in this manner adding depth to the ice formation 14.

Figures 13, 14:
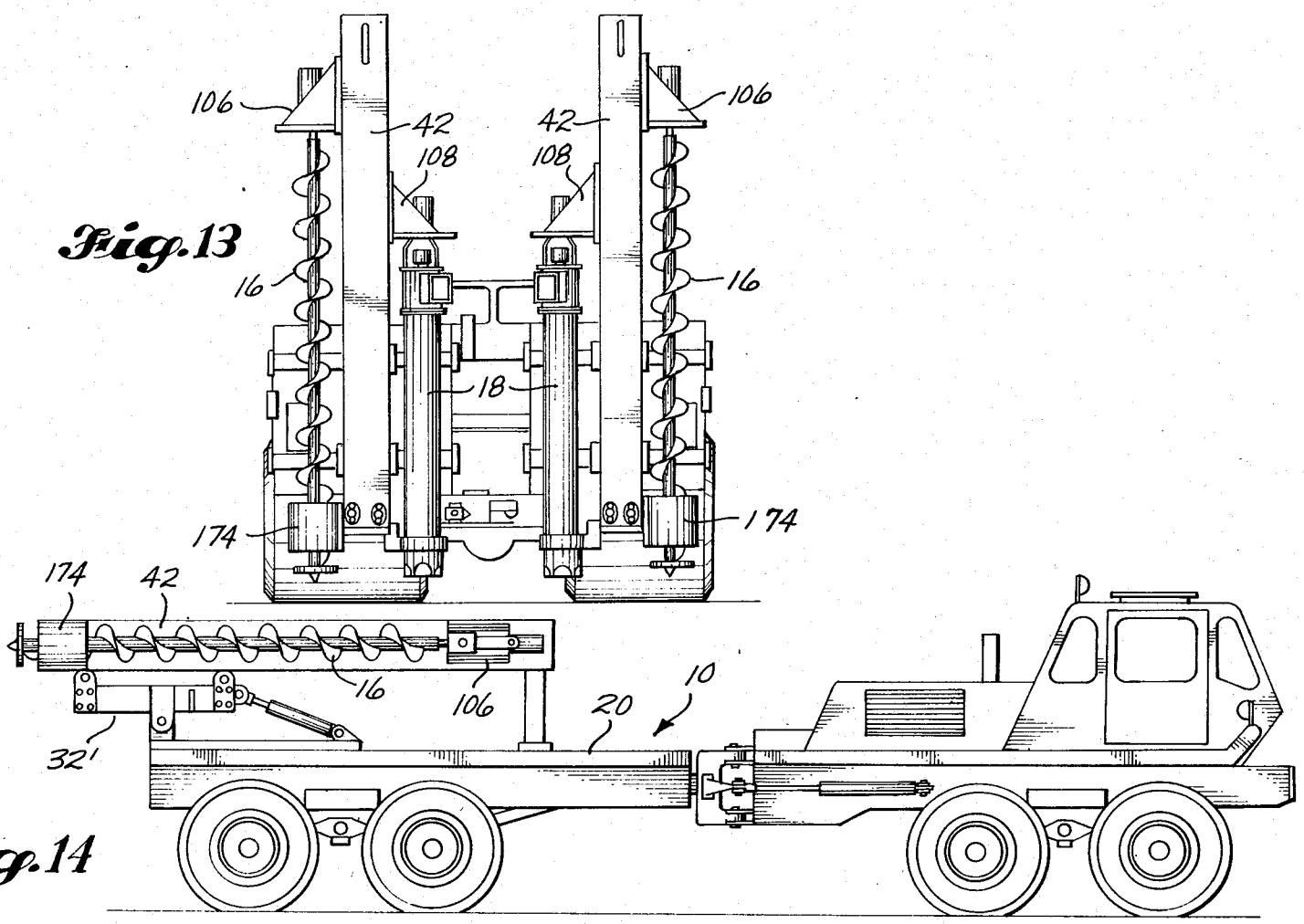
FIG. 13 is a reduced scale view similar to FIG. 1, but showing two auger/pump assemblies in tandem, carried at the rear of a vehicle.
FIG. 14 is a side elevational view of the assembly shown by FIG. 13, showing the two auger/pump assemblies in a supine transport position on a transport vehicle.

FIGS. 13 and 14 show a second form of the invention. In this embodiment, a pair of auger/pump assemblies of the type described are mounted onto the rear end portion of vehicle 10. The frame 32' is made wider so that it will support the two auger/pump assemblies. In other respects, frame 32' is constructed and arranged the same as the frame 32 in the first embodiment. Each of the auger/pump assemblies are like the single auger/-pump assembly that is described above in connection with the embodiments of FIGS. 1–12. The presence of two auger/pump assemblies makes it possible to drill a new hole while the pump is being used for pumping out of another hole.

Of course, various other changes in the construction and arrangement of the auger and/or pump components can be made without departing from the invention. Accordingly, the above described illustrated embodiments are to taken for purposes of example only. The scope and extent of the invention is to be determined solely by the following claims and the established rules of claim interpretation, including the doctrine of equivalents.

What is claimed is:

1. An auger/pump assembly, comprising:

an elongated support tower having a first end and a second end;

an elongated auger adapted to drill a hole in ice, having an ice penetrating first end and a second end;

a first guide secured to the first end of the support tower, having an opening through which the auger extends;

a first support bracket mounted for up and down movement along the support tower;

a first rotary motor mounted onto said first support bracket, drivingly connected to the second end of the auger;

first power means for driving the first bracket up and down along the support tower;

a pump unit having an elongated inlet tube with first and second ends, the first end of said tube constituting the inlet for the pump;

a second guide secured to the first end of the support tower, including an opening through which the inlet tube for the pump extends;

a second support bracket mounted for up and down movement along the support tower;

means connecting the second end of the pump to the second support bracket;

said pump including at least one rotary pump element, a rotary drive motor for said pump element at the second end of the pump unit, and an outlet for the pump at the second end of the pump unit;

second power means for moving the second support bracket up and down along the support tower; and means mounting the support tower for guided lateral movement, so that the auger can be used for boring a hole in ice and then be retracted from the hole, and then the tower can be shifted laterally to place the inlet tube of the pump in line with the hole, so that the pump can then be lowered into the hole.

2. The assembly of claim 1, wherein said support tower comprises a pair of laterally spaced apart channel members, each having a web which is parallel to the web of the other channel member, and each having a pair of flanges which are in coplanar parallelism with the flanges of the other channel, and means extending between the webs of the two channels for securing the two channels together, in a spaced apart relationship, so that slots are formed on the sides of the support tower formed by the flanges, between edge portions of the flanges, and wherein the first and second support brackets each include a slide/guide member having a base portion positioned inwardly of the flanges, and a stem portion in the slot between the flanges, and each said support bracket is secured to the stem portion of its slide/guide member.

3. The assembly of claim 1, wherein the assembly is mounted onto a vehicle.

4. The assembly of claim 3, wherein the assembly is mounted onto a rear portion of the vehicle, so that in use the support tower, the auger, and the pump are positioned outboard of the rear portion of the vehicle.

5. The assembly of claim 4, wherein the support tower and the auger and the pump carried thereby are mounted onto the vehicle for movement between a supine transport position and a generally vertical in use position, with the first ends of the tower, the auger, and the inlet tube for the pump being directed downwardly and the second end of the support tower, the auger and the pump being directed upwardly, when the assembly is in its use position.

6. The assembly of claim 1, wherein the means mounting said assembly for lateral movement comprises a pair of elongated, parallel guide members, and a pair of carriage members, one for each elongated guide member, each said carriage member including bearing means mounting it for sliding movement along its elongated guide member, and means connecting the carriage members to the support tower.

7. The assembly of claim 6, comprising a support frame for the two elongated guide members, and means mounting said support frame for pivotal movement about an axis that is parallel to the two elongated guide members, including a support base, and at least one hydraulic cylinder means innerconnected between said frame and the support base, and operable for rotating the frame in position about said axis.

8. The assembly of claim 7, wherein said base is a bed portion of a vehicle.

9. The assembly of claim 8, wherein said axis extends transversely of the vehicle and is located at a rear portion of the vehicle.

10. The assembly of claim 9, wherein the hydraulic cylinder means is operable to move the frame, and the tower, the auger and the pump carried thereby, between a supine transport position on the vehicle and a substantially vertical in use position.

11. The assembly of claim 7, comprising frame means to which end portions of the elongated guide members are secured, and a chain having end portions secured to said frame, said chain extending generally parallel to said guide members, and motor means carried by said tower including a drive gear engaging said chain, whereby rotation of the drive gear will cause the drive gear to move along the chain and a sideways shift in position of the tower.

12. The assembly of claim 7, comprising frame means to which the end portions of the elongated guide members are secured, and a chain member having end portions secured to said frame, said chain member extending generally parallel to said elongated guide members, and wherein said elongated guide tower includes a support shelf positioned close to said chain, said support shelf carrying a pair of spaced apart idler gears which mesh with said chain, and a drive motor including an output shaft and a drive gear on the output shaft which is also in mesh with said chain, with said chain extending from a first point of securement to said frame to and then partially around a first of said idler gears and then to and around the drive gear and the to and partially around the second idler gear and then to a second point of securement with said frame, whereby rotation of the drive gear will cause the drive gear to travel relatively along the chain, and a shift in position of the support tower.

13. The assembly of claim 12, wherein said base is the bed portion of a vehicle.

14. The assembly of claim 13, wherein said axis extends transversely of the vehicle and is located at a rear portion of the vehicle.

15. The assembly of claim 14, wherein the hydraulic cylinder means is operable to move the frame, and the tower, the auger and the pump carried thereby, between a supline transport position on the vehicle and a substantially vertical in use position.

16. The assembly of claim 15, comprising frame means to which the end portions of the elongated guide members are secured, and a chain member having end portions secured to said frame, said chain member extending generally parallel to said elongated guide members, and wherein said elongated guide tower includes a support shelf positioned close to said chain, said support shelf carrying a pair of spaced apart idler gears which mesh with said chain, and a drive motor including an output shaft and a drive gear on the output shaft which is also in mesh with said chain, with said chain extending from a first point of securement to said frame to and then partially around a first of said idler gears and then to and around the drive gear and then to and partially around the second idler gear and then to a second point of securement with said frame, whereby rotation of the drive gear will cause the drive gear to travel relatively along the chain, and a shift in position of the support tower.

17. The assembly of claim 13, wherein said chain is located between the two elongated guide members.

18. An auger/pump assembly, comprising:

an elongated support tower having a first end and a second end;

an elongated auger adapted to drill a hole in ice, having an ice penetrating first end and a second end;

a first guide secured to the first end of the support tower, having an opening through which the auger extends;

a first support bracket mounted for up and down movement along the support tower;

a first rotary motor mounted onto said first support bracket, drivingly connected to the second end of the auger;

first power means for driving the first bracket up and down along the support tower;

a pump unit having an elongated inlet tube with first and second ends, the first end of said tube constituting the inlet for the pump;

a second guide secured to the first end of the support tower, including an opening through which the inlet tube for the pump extends;

a second support bracket mounted for up and down movement along the support tower;

means connecting the second end of the pump to the second support bracket;

said pump including at least one rotary pump element, a rotary drive motor for said pump element at the second end of the pump unit, and an outlet for the pump at the second end of the pump unit;

second power means for moving the second support bracket up and down along the support tower; and means mounting the support tower for guided lateral movement, so that the auger can be used for boring a hole in ice and then be retracted from the hole, and then the tower can be shifted laterally to place the inlet tube of the pump in line with the hole, so that the pump can then be lowered into the hole;

wherein said support tower comprises a pair of laterally spaced apart channel members, each having a web which is parallel to the web of the other channel member, and each having a pair of flanges which are in coplanar parallelism with the flanges of the other channel, and means extending between the webs of the two channels for securing the two channels together, in a spaced apart relationship, so that slots are formed on the sides of the support tower formed by the flanges, between edge portions of the flanges;

wherein the first and second support brackets each include a slide/guide member having a base portion positioned inwardly of the flanges, and a stem portion in the slot between the flanges, and each said support bracket is secured to the stem portion of its slide/guide member; and wherein the means connecting the two channels together comprises an elongated box beam having a first set of opposite sides which are secured to central portions of the webs of the channel members, and a second opposite pair of sides which are spaced inwardly from the flange portions of the channel members.

19. The assembly of claim 18, wherein each powered drive means comprises a sprocket wheel at each end of the support tower, and a drive chain extending around and between the two sprocket wheels; and means mounting the sprocket wheels onto the support tower, for rotation about parallel axes, said means positioning the sprocket wheels so that the drive chain has an inner run which is located inside of the box beam and an outer run which is located outside of the beam and within the slot region formed between the flanges on its side of the support tower, and a drive motor mounted on the suppport tower and connected to provide a drive input to one of the sprocket wheels, and wherein each support bracket is connected to the drive chain of its powered drive means.

20. The assembly of claim 19, comprising bearing means between the slide/guide member and inner surface portions of the channel flanges, and bearing means between the support bracket and outer surface portions of the channel flanges.

21. The assembly of claim 18, wherein the assembly is mounted onto a vehicle.

22. The assembly of claim 21, wherein the assembly is mounted onto a rear portion of the vehicle, so that in use the support tower, the auger, and the pump are positioned outboard of the rear portion of the vehicle.

23. The assembly of claim 22, wherein the support tower and the auger and the pump carried thereby are mounted onto the vehicle for movement between a supine transport position and a generally vertical in use position, with the first ends of the tower, the auger, and the inlet tube for the pump being directed downwardly and the second end of the support tower, the auger and the pump being directed upwardly, when the assembly is in its use position.

24. The assembly of claim 18, wherein the means mounting said assembly for lateral movement comprises a pair of elongated, parallel guide members, and a pair of carriage members, one for each elongated guide member, each said carriage member including bearing means mounting it for sliding movement along its elongated guide member, and means connecting the carriage members to the support tower.

25. The assembly of claim 24, comprising a support frame for the two elongated guide members, and means mounting said support frame for pivotal movement about an axis that is parallel to the two elongated guide members, including a support base, and at least one hydraulic cylinder means innerconnected between said frame and the support base, and operable for rotating the frame in position about said axis.

26. The assembly of claim 25, wherein said base is a bed portion of a vehicle.

27. The assembly of claim 26, wherein said axis extends transversely of the vehicle and is located at a rear portion of the vehicle.

28. The assembly of claim 27, wherein the hydraulic cylinder means is operable to move the frame, and the tower, the auger and the pump carried thereby, between a supine transport position on the vehicle and a substantially vertical in use position.

29. The assembly of claim 25, comprising frame means to which end portions of the elongated guide members are secured, and a chain having end portions secured to said frame, said chain extending generally parallel to said guide members, and motor means carried by said tower including a drive gear engaging said chain, whereby rotation of the drive gear will cause the drive gear to move along the chain and a sideways shift in position of the tower.

30. The assembly of claim 25, comprising frame means to which the end portions of the elongated guide members are secured, and a chain member having end portions secured to said frame, said chain member extending generally parallel to said elongated guide members, and wherein said elongated guide tower includes a support shelf positioned close to said chain, said support shelf carrying a pair of spaced apart idler gears which mesh with said chain, and a drive motor including an output shaft and a drive gear on the output shaft which is also in mesh with said chain, with said chain extending from a first point of securement to said frame to and then partially around a first of said idler gears and then to and around the drive gear and then to and partially around the second idler gear and then to a second point of securement with said frame, whereby rotation of the drive gear will cause the drive gear to travel relatively along the chain, and a shift in position of the support tower.

31. The assembly of claim 30, wherein said base is the bed portion of a vehicle.

32. The assembly of claim 31, wherein said axis extends transversely of the vehicle and is located at a rear portion of the vehicle.

33. The assembly of claim 32, wherein the hydraulic cylinder means is operable to move the frame, and the tower, the auger and the pump carried thereby, between a supline transport position on the vehicle and a substantially vertical in use position.

34. The assembly of claim 33, comprising frame means to which the end portions of the elongated guide members are secured, and a chain member having end portions secured to said frame, said chain member extending generally parallel to said elongated guide members, and wherein said elongated guide tower includes a support shelf positioned close to said chain, said support shelf carrying a pair of spaced apart idler gears which mesh with said chain, and a drive motor including an output shaft and a drive gear on the output shaft which is also in mesh with said chain, with said chain extending from a first point of securement to said frame to and then partially around a first of said idler gears and then to and around the drive gear and then to and partially around the second idler gear and then to a second point of securement with said frame, whereby rotation of the drive gear will cause the drive gear to travel relatively along the chain, and a shift in position of the support tower.

35. The assembly of claim 31, wherein said chain is located between the two elongated guide members.

36. A support tower for a pair of tools, mounted on the tower for up and down movement along opposite sides of said tower, said tower comprising:

a pair of laterally spaced apart channel members opening inwardly towards each other, each having a web which is parallel to the web or the other channel member, and each having a pair of flanges which are in coplaner parallelism with the flanges of the other channel, and means extending between the webs of the two channels for securing the two channels together, in a spaced apart relationship, so that slots are formed between each coplaner pair of flanges;

a tool support bracket on each side of the tower, each support bracket including a slide/guide member having a base portion positioned inwardly of the flanges on its side of the tower, and a stem portion in the slot between the flanges, and each said support bracket being secured to the stem portion of its slide/guide member;

first power means for driving the first tool support bracket up and down along the support tower; and second power means for driving the second tool support bracket up and down along the support tower.

37. The assembly of claim 36, wherein the assembly is mounted onto a vehicle.

38. The assembly of claim 37, wherein the support tower is mounted onto a rear portion of the vehicle, and is positioned so that in use the support tower is positioned outboard of the rear portion of the vehicle.

39. The assembly of claim 38, wherein the support tower is mounted onto the vehicle for movement between a supine transport position and a generally vertical in use position.

40. The assembly of claim 36, comprising means mounting the tower for lateral movement, comprising a pair of elongated, parallel guide members, and a pair of carriage members, one for each elongated guide member, each said carriage member including bearing means mounting it for sliding movement along its elongated guide member, and means connecting the two carriage members to the support tower.

41. The assembly of claim 40, comprising a support frame for the two elongated guide members, and means mounting said support frame for pivotal movement about an axis that is parallel to the two elongated guide members, including a support base, and at least one hydraulic cylinder interconnected between said frame and the support base, and operable for rotating the frame in position about said axis.

42. The assembly of claim 41, wherein said base is a bed portion of a vehicle.

43. The assmebly of claim 42, wherein said axis extends transversely of the vehicle and is located at a rear portion of the vehicle.

44. The assembly of claim 43, wherein the hydraulic cylinder means is operable to move the frame, and the tower carried thereby, between a supine transport position on the

45. A support tower for a pair of tools, mounted on the tower for up and down movement along opposite sides of said tower, said tower comprising:

a pair of laterally spaced apart channel members opening inwardly towards each other, each having a web which is parallel to the web of the other channel member, and each having a pair of flanges which are in coplaner parallelism with the flanges of the other channel, and means extending between the webs of the two channels for securing the two channels together, in a spaced apart relationship, so that slots are formed between each coplaner pair of flanges;

a tool support bracket on each side of the tower, each support bracket including a slide/guide member having a base portion positioned inwardly of the flanges on its side of the tower, and a stem portion in the slot between the flanges, and each said support bracket being secured to the stem portion of its slide/guide member;

first power means for driving the first tool support bracket up and down along the support tower; and second power means for driving the second tool support bracket up and down along the support tower; and wherein the means connecting the two channels together comprises an elongated box beam having a first set of opposite sides which are secured to central portions of the webs of channel members, and a second pair of sides which are spaced inwardly from the flange portions of the channel members.

46. The assembly of claim 45, wherein each power drive means comprises a sprocket wheel at each end of the support tower, and a drive chain extending around and between the two sprocket wheels; and means mounting the sprocket wheels onto the support tower, for rotation about parallel axes and positioning the sprocket wheels so that the drive chain has an inner run which is located inside of the box beam and an outer run which is located outside of the box beam within the slot region formed between the flanges on its side of the support tower, and a drive motor mounted on the support tower and connected to provide a drive input to one of the sprocket wheels, and wherein each tool support bracket is connected to the drive chain of its power drive means.

47. The assembly of claim 46, comprising bearing means between the slide/guide member and inner surface portions of the channel flanges, and bearing between the support bracket and outer surface portions of the channel flanges.

48. The assembly of claim 45, wherein the assembly is mounted onto a vehicle.

49. The assembly of claim 48, wherein the support tower is mounted onto a rear portion of the vehicle, and is positioned so that in use the support tower is positioned outboard of the rear portion of the vehicle.

50. The assembly of claim 49, wherein the support tower is mounted onto the vehicle for movement between a supine transport position and a generally vertical in use position.

51. The assembly of claim 50, comprising means mounting the tower for lateral movement, comprising a pair of elongated, parallel guide members, and a pair of carriage members, one for each elongated guide member, each said carriage member including bearing means mounting it for sliding movement along its elongated guide member, and means connecting the two carriage members to the support tower.

52. The assembly of claim 51, comprising a support frame for the two elongated guide members, and means mounting said support frame for pivotal movement about an axis that is parallel to the two elongated guide members, including a support base, and at least one hydraulic cylinder interconnected between said frame and the support base, and operable for rotating the frame in position about said axis.

53. The assembly of claim 52, wherein said base is a bed portion of a vehicle.

54. The assmebly of claim 53, wherein said axis extends transversely of the vehicle and is located at a rear portion of the vehicle.

55. The assembly of claim 54, wherein the hydraulic cylinder means is operable to move the frame, and the tower carried thereby, between a supine transport position on the

56. A sideways adjustable tool support mechanism, comprising:

a base;

a frame mounted on said base, said frame including at least one laterally extending, elongated guide member;

a tool supporting tower;

carriage means mounting the tool supporting tower for sideways shifts in position, along said elongated guide member;

power means for shifting said carriage and the tower secured thereto in position laterally of the tower and longitudinally of the elongated guide member; and wherein the means for shifting the carriage and the tower in position comprises a fixed length of chain extending laterally of the tower and at its ends secured to said frame, and motor means mounted on the tower, including a sprocket gear in mesh with said chain, so that rotation of the motor means will cause the sprocket gear to travel relatively along the chain and a sideways shifting movement of the tower.

57. The assembly of claim 56, comprising means mounting said support frame for pivotal movement about an axis that is parallel to said elongated guide member, including at least one hydraulic cylinder interconnected between said frame and the support base, operable for rotating the frame in position about said axis.

58. The assembly of claim 57, wherein said base is a bed portion of a vehicle.

59. A sideways adjustable tool support mechanism comprising:

a base;

a frame mounted on said base, said frame including a pair of parallel, spaced apart, laterally extending, elongated guide members;

a tool supporting tower;

carriage means mounted the tool supporting tower for sideways shifts in position, along said elongated guide members;

power means for shifting said carriage and the tower secured thereto in position laterally of the tower and longitudinally of the elongated guide members, said power means comprising a length of chain extending laterally of the tower and at its end secured to said frame, and motor means mounted on the tower, including a sprocket gear in mesh with said chain, so that rotation of the motor means will cause the sprocket gear to travel relatively along the chain and a sideways shifting movement of the tower; and said carriage comprising a pair of sleeves, one for each guide member, each said carriage surrounding each said guide member, each said sleeve including bearing means which makes sliding engagement with its slide member.

* * * * *